US006401981B1

(12) United States Patent
McCann et al.

(10) Patent No.: US 6,401,981 B1
(45) Date of Patent: Jun. 11, 2002

(54) SANITARY BEVERAGE DISPENSING SPOUT

(75) Inventors: Gerald P. McCann, Los Angeles; Ivan D. Abernathy, Glendale, both of CA (US)

(73) Assignee: McCann' Engineering & Mfg. Co., Los Angeles, CA (US)

( * ) Notice: Subject to any disclaimer, the term of this patent is extended or adjusted under 35 U.S.C. 154(b) by 0 days.

(21) Appl. No.: 09/281,688

(22) Filed: Mar. 30, 1999

(51) Int. Cl.[7] ..... B67D 5/56

(52) U.S. Cl. ..... 222/129.1; 239/424; 239/424.5; 239/DIG. 19

(58) Field of Search ..... 222/129.1, 564, 222/575; 239/DIG. 19, 112, 424.5, 424, 427, 427.3

(56) References Cited

U.S. PATENT DOCUMENTS

| | | | | | |
|---|---|---|---|---|---|
| 1,329,601 | A | | 2/1920 | Hinsdale | |
| 3,423,028 | A | | 1/1969 | Stupakis | 239/427.3 |
| 3,717,284 | A | | 2/1973 | Garrard | 222/108 |
| 3,830,405 | A | * | 8/1974 | Jaeger | |
| 3,898,861 | A | | 8/1975 | McMillin | 62/177 |
| 3,966,091 | A | | 6/1976 | Bencic | 222/129.1 |
| 4,218,014 | A | | 8/1980 | Tracy | 239/106 |
| 4,270,673 | A | | 6/1981 | Rodth | 222/129.3 |
| 4,485,940 | A | | 12/1984 | Brown | 222/129.1 |
| 4,765,513 | A | | 8/1988 | McMillin et al. | 222/129.1 |
| 4,808,346 | A | | 2/1989 | Strenger | 261/18.1 |
| 4,863,068 | A | | 9/1989 | Smith | 222/129.1 |
| 4,928,854 | A | | 5/1990 | McCann et al. | 222/129.1 |
| 4,986,447 | A | | 1/1991 | McCann et al. | 222/129.1 |
| 5,033,646 | A | | 7/1991 | McCann et al. | 222/69 |
| 5,033,651 | A | * | 7/1991 | Whigham et al. | |
| 5,186,363 | A | | 2/1993 | Haynes | 222/145 |
| 5,188,255 | A | | 2/1993 | Du | 222/1 |
| 5,203,474 | A | | 4/1993 | Haynes | 222/129.1 |
| 5,228,597 | A | | 7/1993 | Low | 222/129.1 |
| 5,269,442 | A | | 12/1993 | Vogel | 222/129.1 |
| 5,415,326 | A | * | 5/1995 | Durham et al. | |
| 6,098,842 | A | * | 8/2000 | Schroeder et al. | |

* cited by examiner

*Primary Examiner*—Henry C. Yuen
*Assistant Examiner*—Christopher S. Kim
(74) *Attorney, Agent, or Firm*—Lyon & Lyon LLP

(57) ABSTRACT

A sanitary beverage dispensing spout includes a diffuser housing, a central body integrally formed with the diffuser housing and depending therefrom and discharge ports extending through the bottom of the diffuser housing and opening downwardly about the outer peripheral surface of the central body. The diffuser housing includes a plate diffuser. The central body defines an outer periphery with alternating sets of converging segments. The sets of segments converge at different angles of convergence. Discharge nozzles dispense beverage concentrate from a central manifold extending through the central body. The discharge nozzles define capillary tubes for the retention of a charge of syrup therein between drink dispensing. The flow from the discharge nozzles converges with the converging flow of one set of segments. Flow from a second set of segments converges more rapidly. The mixed beverage concentrate and carbonated water streams continue to converge upon the converged carbonated water stream flowing centrally below the dispensing spout. The outer peripheral surface of the central body is open to atmosphere for the release of outgas carbon dioxide prior to the thorough mixing occurring below the spout assembly.

50 Claims, 3 Drawing Sheets

SANITARY BEVERAGE DISPENSING SPOUT

BACKGROUND OF THE INVENTION

The field of the present invention is beverage dispensing spouts.

In the vending machine and soft drink dispensing industry, two basic problems persist which variously affect the quality of the beverage dispensed. These problems can be interrelated. The first is contamination of the beverage dispensing spout by mold. Mold is developed where beverage concentrate, water and air are present. Contamination by mold can compromise the taste of the beverage and is labor intensive, requiring careful cleaning on a regular basis with removal of the spout. Such cleaning frequently includes the use of chemicals which can affect the taste of the beverage.

The second problem is the limited flow rates available for dispensed carbonated beverages. This basic problem manifests itself in excessive foaming of the drink when flow rates are increased, causing spillage and overflow. In addition, excessive foaming reduces the efficiency of the operator responsible for dispensing the drinks, requiring the operator to suspend the filling cycle to permit foam reduction before topping off the drink. Therefore, in commercial settings, it is desirable to reduce mold formation and to increase flow rate without degradation in the quality of the dispensed beverage.

Some increase in flow rate has been achieved through a maintenance of the separation of beverage concentrate and carbonated water as it is being dispensed. Carbonated water will effervesce without significant foam when not in the presence of beverage concentrates. By only avoiding the mixing of the two liquids until reaching the cup, mixing is reduced, as is mold formation. However, stratification of the beverage concentrate typically results.

Further, keeping the beverage concentrate and carbonated water separated typically does not fully resolve the quality problem with high flow rates. High pressure carbonated water used with conventional dispensing equipment, typically in the range of 60–120 psig, must be reduced to atmospheric pressure. In this reduction, carbon dioxide will come out of a supersaturated solution. This outgassing needs to occur before mixing with the beverage concentrate to control foam. A rapid drop in pressure before mixing can result in excessive outgassing and a flat drink, but without foam. A gentle drop in pressure but with intermixing of the beverage components before outgassing is complete due to high flow rates can result in excessive foaming.

U.S. Pat. No. 4,928,854 discloses a compromise of features to address the foaming issue at high flow rates. Reducing the pressure gently and extending the time for gentle flow at atmospheric pressure provide needed outgassing, without excessive outgassing, before mixing. A splitting of the stream of carbonated water into a major flow down the outside of the spout for unimpeded outgassing and a minor flow within the spout for mixing with the beverage concentrate reduces foaming and yet allows dilution of the concentrate so that stratification is avoided. The mixing of the beverage concentrate with carbonated water and in the presence of oxygen within the spout, however, does not address the problem of mold formation.

SUMMARY OF THE INVENTION

The present invention is directed to a sanitary beverage dispensing spout capable of high flow rates. Discharge ports open downwardly about the outer peripheral surface of a central body. One or more discharge nozzles extend to the lower part of the central body. The configuration is particularly applicable for the separated and sanitary discharge of carbonated water from the discharge ports and the beverage concentrate from the discharge nozzles.

In a first separate aspect of the present invention, the central body includes converging segments extending to intersection with the bottom surface of the central body. Two sets of such segments are provided with one set intersecting the bottom surface radially inward of the other set. The discharge nozzles are located radially adjacent and inward from the more outward set and circumferentially adjacent the other set of converging segments. The segments may be. positioned to alternate about the central body. The discharge nozzles may be radially adjacent each one of the segments of the outer set of converging segments, respectively. Separate flow of beverage concentrate and carbonated water inhibit mold formation and yet appropriate mixing can occur and at elevated flow rates.

In a second separate aspect of the present invention, the central body includes an outer peripheral surface having two sets of converging segments, one set having a greater angle of convergence than the other. The discharge nozzle(s) are radially adjacent and inward of the lower end of one set of converging segments having a lesser angle of convergence. Flow down the outside of the central body is thus divided into streams, some of which converge together below the central body before intersecting one or more streams from the discharge nozzle(s) and the other of which converge directly with one or more streams from the discharge nozzle (s).

In a third separate aspect of the present invention, the beverage dispensing spout includes the discharge nozzle(s) opening downwardly from the central body. Each discharge nozzle includes a capillary tube extending to the surface of the central body. Such tubes retain liquid concentrate and, therefore, do not allow air to get into the discharge nozzle(s). Beverage concentrate in the presence of air can create a viable environment which requires frequent cleaning.

In a fourth separate aspect of the present invention, the central body includes an outer peripheral surface having two sets of converging segments, one set having a greater angle of convergence than the other. The discharge nozzles are radially adjacent and inward of the converging segments having a lesser angle of convergence and are. Flow down the outside of the central body is thus divided into streams, some of which converge together below the central body before intersecting the streams from the discharge nozzles and the other of which converge directly with the streams from the discharge nozzles. The discharge nozzles opening downwardly through the bottom surface of the central body include capillary tubes extending to the bottom surface. These tubes retain liquid concentrate and, therefore, do not allow air to get into the discharge nozzles. Thus, with beverage concentrate separated from both air and water, the growth of mold is inhibited and there is no need to remove the spout for cleaning.

In a fifth separate aspect of the present invention, a diffuser is associated with the beverage dispensing spout, the discharge ports being in communication with the diffuser. The discharge nozzles are not in communication with the diffuser. Thus, flow through the diffuser and down the. outside of the central body occurs prior to mixing with streams from the discharge nozzles. Outgassing of carbonated water is thus able to freely occur prior to mixing with the concentrate.

In a sixth separate aspect of the present invention, combinations of the foregoing separate aspects are contemplated.

Accordingly, it is an object of the present invention to provide a sanitary beverage dispensing spout capable of a high rate of flow. Other and further objects and advantages will appear hereinafter.

DETAILED DESCRIPTION OF THE PREFERRED EMBODIMENT

Figure 1:
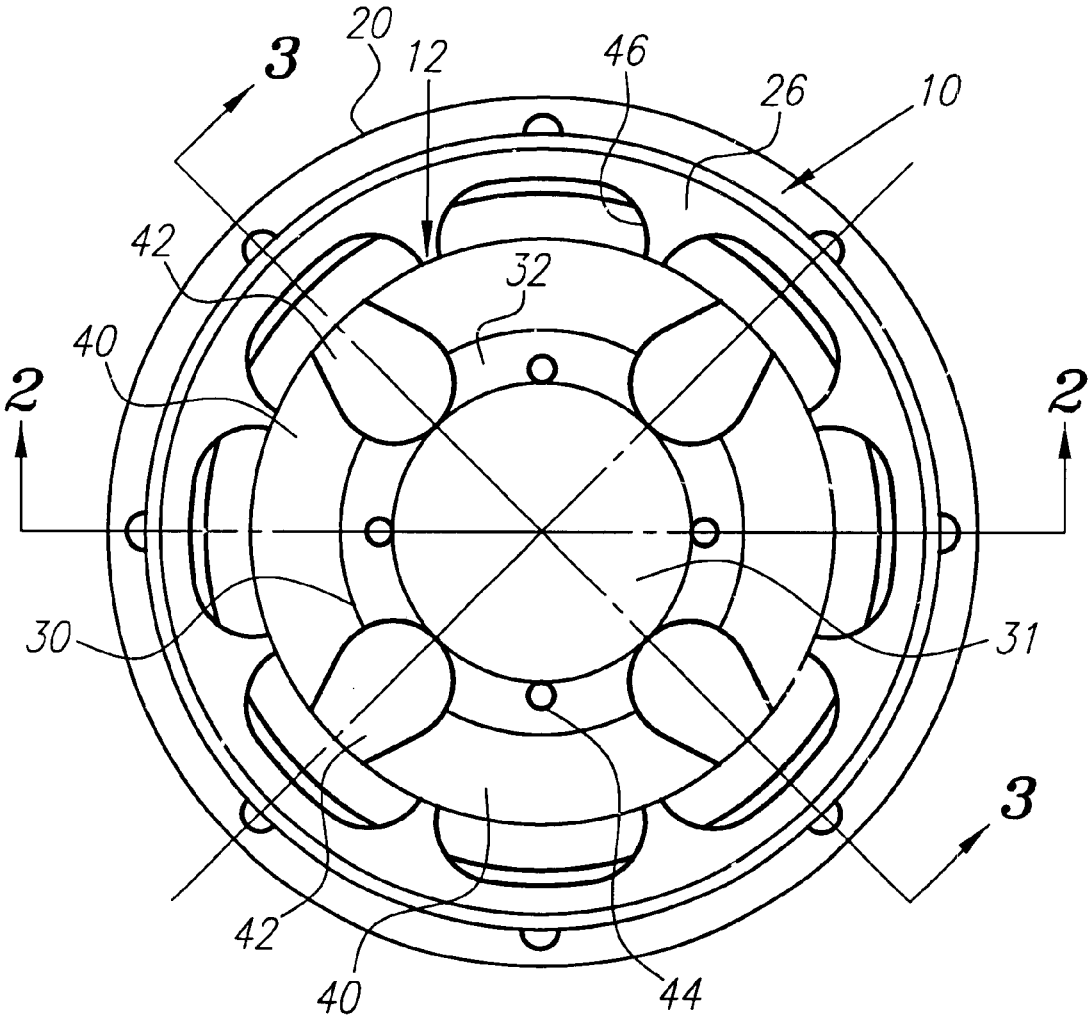
FIG. 1 is a bottom view of the spout.

Turning in detail to the drawings, a beverage dispensing spout is illustrated as generally including a diffuser housing 10 and a central body 12. The central body 12 includes an interior body 14 which defines a number of the interior passageways while a cap 16 provides closure within the diffuser housing 10.

Looking first to the diffuser housing 10, a cylindrical wall 18 includes a circumferential flange 20 defining a mounting shoulder 22 which abuts against the rim of a socket in a dispenser (not shown). Lugs 24 are arranged about the cylindrical wall 18 and are displaced above the mounting shoulder 22 to cooperate with the dispenser in a bayonet mounting. A bottom wall 26 extends inwardly from the cylindrical wall 18. The central body 12 is integrally formed with the diffuser housing 10 in this embodiment. The central body includes an inverted cap structure having a bottom surface 30. This bottom surface 30 includes a concave central area 31 in a generally flat ring 32. A sidewall 33, circular in cross section, extends from the bottom 28 to the bottom wall 26. This arrangement defines a central cavity 34.

Looking to the outer peripheral surface of the central body 12, several portions may be defined. A first cylindrical surface 36 is located adjacent the bottom wall 26. An outwardly extending shoulder 38 extends from the lower end of the first cylindrical surface 36. From this shoulder 38, converging segments extend to the bottom surface 30. The two sets of converging segments are illustrated in this embodiment to include four segments 40 and 42 each. The segments of each set alternate and are conveniently equiangularly placed. Other numbers of segments and their relative sizes are contemplated as well. Further, one set of the converging segments 42 may extend beyond the other set of segments 40 or even extend fully to a common point.

One set of converging segments 40 has a smaller included angle of convergence than the other set of converging segments 42. The converging segments 40 generally define a conical surface between the bottom surface and the outwardly extending shoulder 38. The second converging segments 42 are cut into that conical surface. The converging segments 40 intersect with the bottom surface 30 about the outer periphery of the ring 32. The converging segments 42, cutting into that conical surface, intersect with the bottom surface 30 at the inside periphery of the ring 32. This arrangement provides for the intersections of the bottom surface 30 with the converging segments 42 having greater convergence being radially inwardly of the intersections between the bottom surface 30 and the converging segments 42 with a lesser convergence. Further, the trajectories of liquid experiencing boundary layer flow about the peripheral surface of the central body 12 will be different for the two sets of converging segments 40 and 42. The flow across the segments 42 will converge more quickly, passing inwardly of the adjacent segments 40, and meet at a higher location than flow across the converging segments 40.

Figure 2:
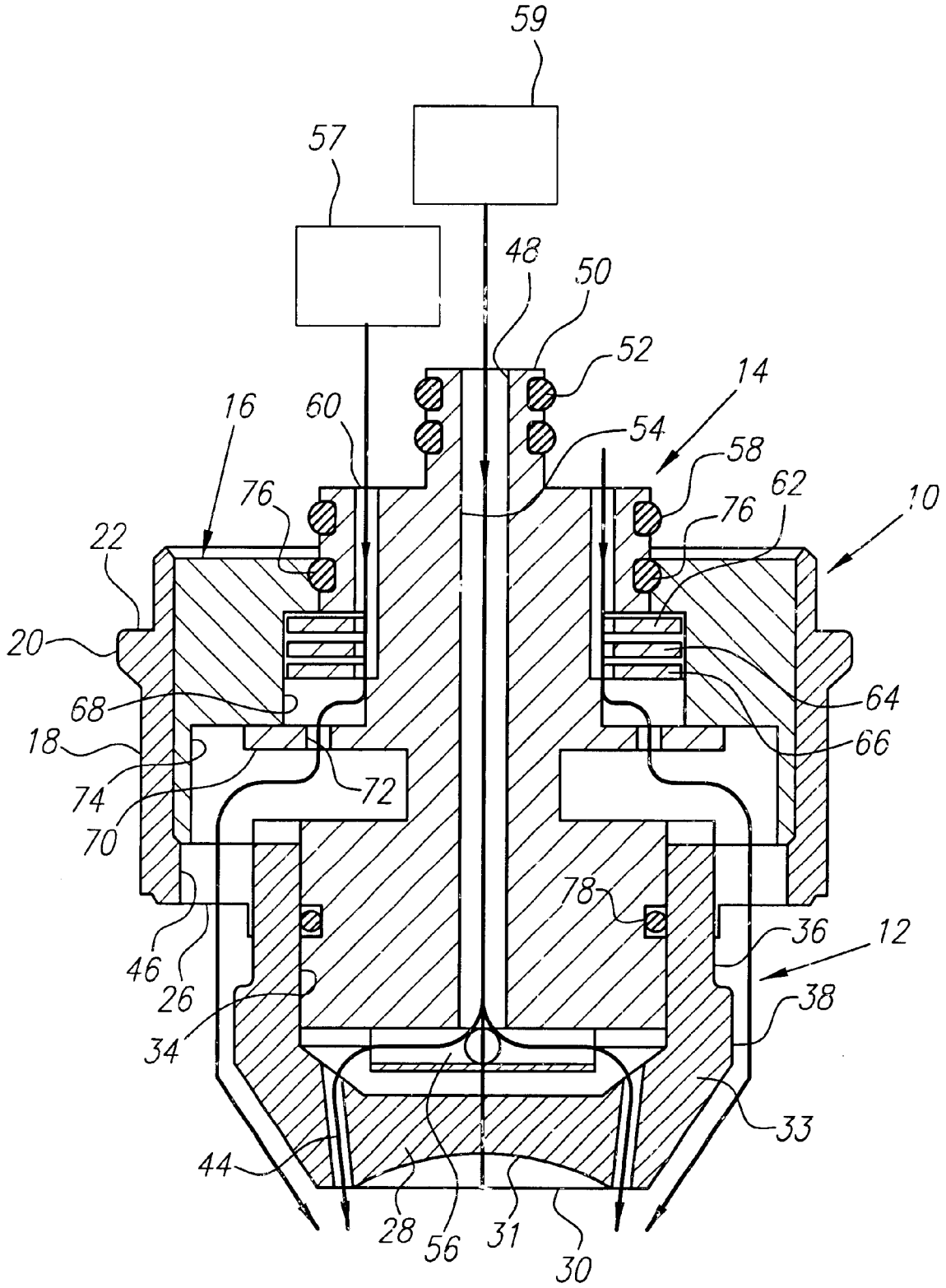
FIG. 2 is a cross-sectional side view taken along line 2—2 of FIG. 1.
Figure 3:
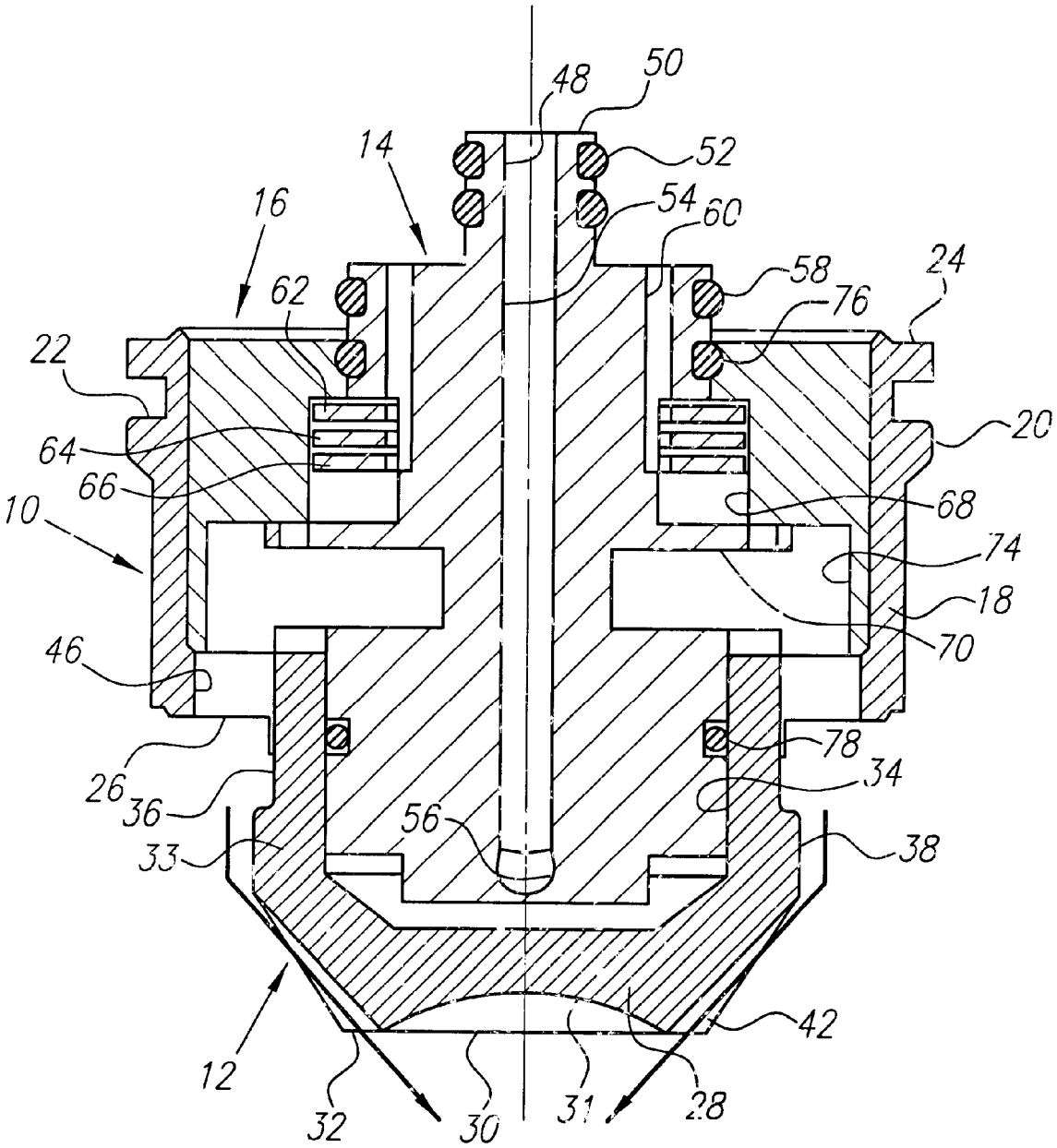
FIG. 3 is a. cross-sectional side view taken along line 3—3 of FIG. 1.

Discharge nozzles 44 are located through the bottom 28 of the central body 12. These discharge nozzles 44 are shown to be radially adjacent and inward from the converging segments 40 and circumferentially adjacent the converging segments 42. Further, the discharge nozzles are radially outward of the innermost extent of the intersection between the bottom surface 30 and the converging segments 42. These relationships between the segments 40 and 42 and the discharge nozzles 44 can best be seen in the bottom view of FIG. 1. As can be seen from FIG. 2, the discharge nozzles 44 are shown to slightly converge with a smaller angle of convergence than the converging segments 40 and 42.

These discharge nozzles 44 are capillary tubes with preferred diameters of 0.060 to 0.072 inches. There is a plurality of such discharge nozzles 44 which helps to discharge the beverage concentrate with an appropriate pressure drop through the very thin nozzles. The discharge nozzles 44 define capillary tubes in the sense that the beverage concentrate will remain in and fill each nozzle tube 44. As each tube 44 is filled with beverage concentrate, air cannot access any part of the entire spout where beverage concentrate exists except for the bottom surface 30. Even so, the bottom surface 30 is also only minimally impacted, if at all, by random drops of beverage concentrate. The surface can be very easily cleaned to avoid the build-up of any mold that otherwise plagues beverage dispensing spouts and there is no need to remove the spout for internal cleaning beyond the. periodic flushing of the syrup lines.

Discharge ports 46 extend through the bottom wall 26 of the diffuser housing 10 at the central body 12. These discharge ports 46 are directed downwardly along the outer peripheral surface of the central body 12. As can be seen from FIG. 1, the discharge ports 46 are ovular to take up substantially the full periphery about the outer peripheral surface. Conveniently there is one discharge port 46 for each of the segments 40 and 42. However, this is not believed to be a critical requirement.

The interior body 14 defines a manifold 48 for the beverage concentrate. The manifold 48 presents a source 59 of beverage concentrate or syrup at its upper end 50. O-rings 52 seal the supply of syrup. A vertical passage 54 extends downwardly to adjacent the discharge nozzles 44. Crossed horizontally extending passages 56 evenly distribute the syrup about the lower end of the cavity 34. Thus, the manifold 48 includes an inlet at the upper end 50 and outlets through the passages 56.

The interior body 14 further defines a source of pressurized carbonated water extending concentrically about the source of syrup. An O-ring 58 seals this pressure. Passages 60 through the interior body 14 deliver the soda to a diffuser. The diffuser includes diffuser plates 62, 64 and 66. These plates 62-66 are integrally formed with the interior body 14. The passages 60 extend downwardly through each of these plates. Additionally, flow can be directed radially outwardly in the spaces to either side of each of the plates. One diffuser of this type is illustrated in U.S. Pat. No. 4,928,854, the disclosure of which is incorporated herein by reference.

A first expansion cavity 68 is arranged concentrically about the interior body 14 below the bottom plate 66 of the diffuser. A circular baffle 70 is below the expansion cavity 68 and includes holes 72 for flow from the expansion cavity 68. A second annular expansion cavity 74 is located below the baffle 70' and provides communication to the discharge ports 46. The cap 16 is configured to seal against the interior body 14 above the diffuser by means of the O-ring 76. This cap defines the diffuser cavity and is displaced outwardly from the peripheral edges of the diffuser plates 62, 64 and 66. This allows flow of carbonated water and free carbon dioxide into the expansion cavity 68 about the periphery of the plates 62–66. The cap 16 also abuts against the outer edge of the circular baffle 70 to force flow through the holes 72 into the second expansion cavity 74.

The interior body 14 further defines a source 57 of pressurized carbonated water extending concentrically about the source 59 of syrup. An O-ring 58 seals this pressure. Passages 60 through the interior body 14 deliver the soda to a diffuser. The diffuser includes diffuser plates 62, 64 and 66. These plates 62–66 are integrally formed with the interior body 14. The passages 60 extend downwardly through each of these plates. Additionally, flow can be directed radially outwardly in the spaces to either side of each of the plates. One diffuser of this type is illustrated in U.S. Pat. No. 4,928,854, the disclosure of which is incorporated herein by reference.

In operation, a valve in the dispensing component (not shown) distributes beverage concentrate and carbonated water at preselected rates for appropriate mixing. The syrup and soda are sourced through the upper end 50 6f the manifold 48 and the vertical passages 60. The syrup flows directly down to the discharge nozzles 44. Because of the capillary characteristic of the discharge nozzles 44, a charge of syrup exists in the manifold 48. As the charge remains both before and after syrup is dispensed, the appropriate ratio is maintained. The carbonated water flows down through the vertical passages 54 and into the diffuser. The vertical passages 54 continue through the plates 62, 64 and 66. Flow also passes outwardly on the plates 62, 64 and 66 to flow downwardly about the periphery thereof. Pressure is being reduced through this diffuser and outgassing of carbon dioxide takes place. The final restriction is provided by the circular baffle 70 where flow is distributed about the circumference of the interior body 14. The carbonated water and gas then enters the lower expansion cavity 74 and is allowed to flow freely through the discharge ports 46. The discharge ports 46 are intended to be of sufficient cross-sectional area that there is no nozzle effect with pressure converted to velocity.

As the flow is discharged from the discharge ports 46, it flows downwardly and over the outwardly extending shoulder 38. The shoulder 38 disrupts the flow to condition it for passage over the converging segments 40 and 42. Due to boundary layer effects, the carbonated water flows downwardly and inwardly in trajectories defined by the segments 40 and 42. As this entire outer surface of the central body 12 is at atmospheric pressure, outgassing carbon dioxide is allowed to freely escape.

There are three defined groups of trajectories of flow from the bottom surface 30 of the central body 12. One group of trajectories is defined by the discharge nozzles 44. As previously mentioned, these nozzles direct beverage concentrate in slightly converging streams. A second group is defined by the converging segments 40 providing an intermediate convergence and being radially adjacent to the discharge nozzles 44. Consequently, these two groups of trajectories intersect at a small angle of convergence to flow as four streams downwardly. The four streams, of course, quickly converge.

Angularly offset from the four streams defined by the two groups of trajectories, trajectories of greater convergence are defined by the converging segments 42. These trajectories converge at a central location above the convergence of the four streams of mixed carbonated water and beverage concentrate. Thus, as the four streams of mixture converge, they converge on the stream defined by the most converging group of trajectories. As excess carbon dioxide is generally released through the diffuser and the exterior surface of the central body 12, excessive foaming when the beverage concentrate mixes with the carbonated water is avoided. Further, the direction of the trajectories is such that substantial mixing occurs and stratification of beverage concentrate within the drink is avoided.

Accordingly, a sanitary high flow beverage dispensing spout is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A beverage dispensing spout comprising a central body including an outer peripheral surface and a plurality of discharge nozzles each having a capillary tube extending to the surface of the central body, the outer peripheral surface having first converging segments converging downwardly to define first trajectories of boundary layer flow, second converging segments converging downwardly to define second trajectories of boundary layer flow, the central body further including a bottom surface extending to intersections with the first converging segments, and the discharge nozzles defining third trajectories of flow, the first converging segments, the second converging segments and the discharge nozzles being arranged with the first trajectories intersecting the third trajectories before the first trajectories converge and the second trajectories converging without intersecting the third trajectories;

discharge ports opening downwardly about the outer peripheral surface of the central body.

2. The beverage dispensing spout of claim 1, further comprising a source of carbonated water in controlled communication with the discharge ports;

a source of syrup in controlled communication with the at least one discharge nozzle.

3. The beverage dispensing spout of claim 2, further comprising a diffuser housing, the central body extending from the diffuser housing;

a diffuser in the diffuser housing between the source of carbonated water and the discharge ports, the discharge ports extending through the bottom of the diffuser housing.

4. The beverage dispensing spout of claim 3, the central body sealing the at least one discharge nozzle from the diffuser and the discharge ports.

5. The beverage dispensing spout of claim 1, at least a portion of the outer peripheral surface being exposed to atmosphere.

6. The beverage dispensing spout of claim 1, the second converging segments extending to intersections with the bottom surface.

7. A beverage dispensing spout comprising a central body including an outer peripheral surface having first converging segments converging downwardly, second converging segments converging downwardly, a bottom surface extending to intersections with the first converging segments, and discharge nozzles opening downwardly through the bottom surface, the second converging segments passing radially inwardly of the intersections of the first converging segments with the bottom surface, the discharge nozzles being radially adjacent and inward of the first converging segments and being circumferentially adjacent of the second converging segments;

discharge ports opening downwardly about the outer peripheral surface of the central body.

8. The beverage dispensing spout of claim 7, the second converging segments extending to intersections with the bottom surface, the discharge nozzles being radially outward of the inward-most extent of the intersections of the second converging segments with the bottom surface.

9. The beverage dispensing spout of claim 7, the outer peripheral surface further having a first cylindrical surface adjacent the discharge ports and an outwardly extending shoulder facing the discharge ports and between the first cylindrical surface and the first converging segments and the second converging segments.

10. The beverage dispensing spout of claim 7, the discharge nozzles being radially adjacent and inward of the first converging segments, respectively.

11. The beverage dispensing spout of claim 10, the discharge nozzles being between adjacent second converging segments, respectively.

12. The beverage dispensing spout of claim 11, there being four each of the discharge nozzles, the first converging segments and the second converging segments.

13. The beverage dispensing spout of claim 11, the discharge nozzles, the first converging segments and the second converging segments each being equiangularly oriented on the central body.

14. The beverage dispensing spout of claim 7, the second converging segments having a greater angle of convergence than the first converging segments.

15. The beverage dispensing spout of claim 7, further comprising a diffuser housing, the central body extending from the diffuser housing;

a diffuser positioned within the diffuser housing and including a diffuser inlet and a diffuser outlet, the diffuser outlet being in communication with the discharge ports.

16. The beverage dispensing spout of claim 15, the central body sealing the discharge nozzles from the diffuser, the diffuser outlet and the discharge ports.

17. The beverage dispensing spout of claim 16, the central body including a manifold having a manifold inlet and manifold outlets to the discharge nozzles.

18. The beverage dispensing spout of claim 7, further comprising a source of carbonated water in controlled communication with the discharge ports;

a source of syrup in controlled communication with the discharge nozzles.

19. The beverage dispensing spout of claim 18, further comprising a diffuser housing, the central body extending from the diffuser housing;

a diffuser in the diffuser housing between the source of carbonated water and the discharge ports.

20. The beverage dispensing spout of claim 18, the discharge nozzles including capillary tubes extending to the bottom surface.

21. The beverage dispensing spout of claim 7, the first converging segments defining first trajectories of boundary layer flow, the second converging segments defining second trajectories of boundary layer flow, the discharge nozzles defining third trajectories of flow, the first converging segments, the second converging segments and the discharge nozzles being arranged with the first trajectories intersecting the third trajectories before the first trajectories converge and the second trajectories converging without intersecting the third trajectories.

22. The beverage dispensing spout of claim 7, at least a portion of the outer peripheral surface being exposed to atmosphere.

23. A beverage dispensing spout comprising a central body including an outer peripheral surface having first converging segments converging downwardly, second converging segments converging downwardly, a bottom surface extending to intersections with the first converging segments and the second converging segments, and discharge nozzles opening downwardly through the bottom surface, the second converging segments having a greater angle of convergence than the first converging segments, the discharge nozzles being radially adjacent and inward of the first converging segments and being between adjacent second converging segments;

discharge ports opening downwardly about the outer peripheral surface of the central body.

24. The beverage dispensing spout of claim 23, the discharge nozzles being radially adjacent and inward of the first converging segments, respectively.

25. The beverage dispensing spout of claim 24, further comprising a diffuser housing, the central body extending from the diffuser housing;

a diffuser in the diffuser housing between the source of carbonated water and the discharge ports, the discharge ports extending through the bottom of the diffuser housing.

26. The beverage dispensing spout of claim 23, there being four each of the discharge nozzles, the first converging segments and the second converging segments.

27. The beverage dispensing spout of claim 23, the discharge nozzles, the first converging segments and the second converging segments each being equiangularly oriented on the central body.

28. The beverage dispensing spout of claim 23, further comprising a diffuser housing, the central body extending from the diffuser housing;

a diffuser positioned within the diffuser housing and including a diffuser inlet and a diffuser outlet, the diffuser outlet being in communication with the discharge ports.

29. The beverage dispensing spout of claim 28, further comprising an inner body sealing the discharge nozzles from the diffuser, the diffuser outlet and the discharge ports.

30. The beverage dispensing spout of claim 29, the inner body being in the central body and including a manifold having a manifold inlet and manifold outlets to the discharge nozzles.

31. The beverage dispensing spout of claim 23, further comprising a source of carbonated water in controlled communication with the discharge ports;

a source of syrup in controlled communication with the discharge nozzles.

32. The beverage dispensing spout of claim 31, further comprising a diffuser in the diffuser housing between the source of carbonated water and the discharge ports.

33. The beverage dispensing spout of claim 31, the discharge nozzles including capillary tubes extending to the bottom surface.

34. The beverage dispensing spout of claim 23, the first converging segments defining first trajectories of boundary layer flow, the second converging segments defining second trajectories of boundary layer flow, the discharge nozzles defining third trajectories of flow, the first converging segments, the second converging segments and the discharge nozzles being arranged with the first trajectories intersecting the third trajectories before the first trajectories converge and the second trajectories converging without intersecting the third trajectories.

35. The beverage dispensing spout of claim 23, at least a portion of the outer peripheral surface being exposed to atmosphere.

36. A beverage dispensing spout comprising a diffuser housing;

a central body extending below the diffuser housing and including an outer peripheral surface having first converging segments converging downwardly, second converging segments converging downwardly, a bottom surface extending to intersections with the first converging segments and the second converging segments, and discharge nozzles opening downwardly through the bottom surface, the intersections of the second converging segments with the bottom surface being radially inward of the intersections of the first conveying segments with the bottom surface, the second converging segments having a greater angle of convergence than the first converging segments, the discharge nozzles being radially adjacent and inward of the first converging segments, respectively, circumferentially between adjacent second converging segments, respectively, and radially outward of the inward-most extent of the intersections of the second converging segments with the bottom surface;

discharge ports opening downwardly about the outer peripheral surface of the central body.

37. The beverage dispensing spout of claim 36, further comprising a diffuser positioned within the diffuser housing and including a diffuser inlet and a diffuser outlet, the diffuser outlet being in communication with the discharge ports, the discharge ports extending through the bottom of the diffuser housing.

38. The beverage dispensing spout of claim 37, further comprising an inner body in the central body sealing the discharge nozzles from the diffuser, the diffuser outlet and the discharge ports.

39. The beverage dispensing spout of claim 36, the inner body including a manifold having a manifold inlet and manifold outlets to the discharge nozzles.

40. The beverage dispensing spout of claim 36, further comprising a source of carbonated water in controlled communication with the discharge ports;

a source of syrup in controlled communication with the discharge nozzles.

41. The beverage dispensing spout of claim 40, further comprising a diffuser in the diffuser housing between the source of carbonated water and the discharge ports.

42. The beverage dispensing spout of claim 40, the discharge nozzles including capillary tubes extending to the bottom surface.

43. The beverage dispensing spout of claim 36, the first converging segments defining first trajectories of boundary layer flow, the second converging segments defining second trajectories of boundary layer flow, the discharge nozzles defining third trajectories of flow, the first converging segments, the second converging segments and the discharge nozzles being arranged with the first trajectories intersecting the third trajectories before the first trajectories converge and the second trajectories converging without intersecting the third trajectories.

44. The beverage dispensing spout of claim 36, at least a portion of the outer peripheral surface being exposed to atmosphere.

45. A beverage dispensing spout comprising a central body including an outer peripheral surface having first converging segments converging downwardly to define first trajectories of boundary layer flow, second converging segments converging downwardly to define second trajectories of boundary layer flow, a bottom surface extending to intersections with the first converging segments and the second converging segments, and discharge nozzles opening downwardly through the bottom surface to define third trajectories of flow, the first converging segments, the second converging segments and the discharge nozzles being arranged with the first trajectories intersecting the third trajectories before the first trajectories converge and the second trajectories converging without intersecting the third trajectories;

discharge ports extending through the bottom of the diffuser housing and opening downwardly about the outer peripheral surface of the central body.

46. The beverage dispensing spout of claim 45, further comprising a source of carbonated water in controlled communication with the discharge ports;

a source of syrup in controlled communication with the discharge nozzles.

47. The beverage dispensing spout of claim 46, further comprising a diffuser housing, the central body extending from the diffuser housing;

a diffuser in the diffuser housing between the source of carbonated water and the discharge ports.

48. The beverage dispensing spout of claim 46, the discharge nozzles including capillary tubes extending to the bottom surface.

49. The beverage dispensing spout of claim 45, there being four each of the discharge nozzles, the first converging segments and the second converging segments.

50. The beverage dispensing spout of claim 45, at least a portion of the outer peripheral surface being exposed to atmosphere.

* * * * *

UNITED STATES PATENT AND TRADEMARK OFFICE

CERTIFICATE OF CORRECTION

PATENT NO. : 6,401,981 B1 
DATED : June 11, 2002
INVENTOR(S) : Gerald P. McCann

It is certified that error appears in the above-identified patent and that said Letters Patent is hereby corrected as shown below:

Column 9,
Line 65, delete "36" and insert therefor -- 38 --.

Signed and Sealed this

Eighteenth Day of March, 2003

JAMES E. ROGAN
*Director of the United States Patent and Trademark Office*